United States Patent [19]

Bennelli

[11] 4,129,154

[45] Dec. 12, 1978

[54] ELECTRONIC DEVICE FOR CONTROLLING THE WINDING OFF OF MATERIAL WOUND UP ON A CORE BY TENSIOMETRIC CONTROL

[76] Inventor: Dore D. Bennelli, Via Goletti 3, Borgo Ticino (Novaro), Italy, 28040

[21] Appl. No.: 866,952

[22] Filed: Jan. 5, 1978

Related U.S. Application Data

[63] Continuation-in-part of Ser. No. 707,502, Jul. 22, 1976, abandoned.

[30] Foreign Application Priority Data

Aug. 8, 1975 [IT] Italy ..... 26225 A/75

[51] Int. Cl.[2] ..... D03D 49/06

[52] U.S. Cl. ..... 139/110; 139/97; 66/211; 242/75.5; 318/6

[58] Field of Search ..... 139/97, 99, 105, 106, 139/108, 109, 110, 107; 242/75.5, 75.51, 75.52; 318/6; 66/211

[56] References Cited

U.S. PATENT DOCUMENTS

| | | | |
|---|---|---|---|
| 2,627,592 | 2/1953 | Hutton et al. | 318/6 |
| 2,775,414 | 12/1956 | Rush et al. | 242/75.5 |
| 3,072,154 | 1/1963 | Locher | 139/110 |
| 3,076,615 | 2/1963 | Connors | 66/211 |
| 3,125,127 | 3/1964 | Locher | 139/97 |
| 3,878,872 | 4/1975 | Hintsch | 139/110 X |
| 3,893,489 | 7/1975 | Bassing et al. | 139/110 |
| 3,930,523 | 1/1976 | Garcia | 139/110 X |
| 3,934,620 | 1/1976 | Garcia | 139/110 X |

FOREIGN PATENT DOCUMENTS

| | | | |
|---|---|---|---|
| 2155852 | 5/1973 | France | 139/110 |
| 371406 | 9/1963 | Switzerland | 139/110 |
| 1099725 | 1/1968 | United Kingdom | 139/110 |

*Primary Examiner*—James Kee Chi

*Attorney, Agent, or Firm*—McGlew and Tuttle

[57] ABSTRACT

A lever, pivoted intermediate its ends, rotatably mounts a roller at one end engaging the material being wound off a core. In one embodiment, the lever is spring biased in a direction to bias the roller against the material, and changes in the position of the opposite end of the lever are effective to adjust a potentiometer forming the control element of an asynchronous single phase variator. In another embodiment of the invention, the spring is omitted, and a pressure-resistance detector is mounted between the opposite end of the lever and a frame. In a third embodiment of the invention, the opposite end of the lever carriers a shutter cooperable with a photoelectric control, the lever being spring biased in this embodiment. The pressure-resistance detector can be substituted in the variator for the potentiometer. The variator controls the speed of an induction motor effecting angular displacement of the core, and the speed of the induction motor is controlled by micro-displacements of the lever carrying the roller engaging the material being wound off. The induction motor can be stopped substantially instantaneously, upon breaking of the material, by injection of a D.C. voltage into the induction motor.

7 Claims, 5 Drawing Figures

ELECTRONIC DEVICE FOR CONTROLLING THE WINDING OFF OF MATERIAL WOUND UP ON A CORE BY TENSIOMETRIC CONTROL

CROSS REFERENCE TO RELATED APPLICATION

This application is a continuation in part of application Ser. No. 707,502, now abandoned filed July 22, 1976, for "AN ELECTRIC DEVICE FOR CONTROLLING THE WINDING OFF OF MATERIAL WOUND UP ON A CORE BY TENSIOMETRIC CONTROL".

FIELD AND BACKGROUND OF THE INVENTION

The present invention relates, in general, to an electro-mechanical device for controlling the winding off speed of a reel having material thereon, and more particularly, to an electro-mechanical device controlling the winding off speed of a beam, forming part of a loom, and having yarns wound thereon, a control being effected by a combination of the tensiometric detection of the tension in the wound off yarn and an electronic A.C. speed change gear for an induction motor deriving the beam.

The present Inventor is the patentee of a Italian Pat. No. 929,025 disclosing an electronic A.C. speed change gear for induction motors, and the present invention is directed to a successful combination of a tensiometric control device and a speed change gear such as disclosed in Italian Pat. No. 929,025.

Warp let-off devices are used extensively in the fabric weaving industry to ensure the warp, or a plurality of individual thread lengths, extending from a feeding roller or beam to the take-up mechanism of the loom and to weaving devices of the loom, being maintained at substantially constant tension and feeding speed. If abrupt changes in tension occur, or if the feeding speed of the feed roller or beam changes from that of the take-up rollers, there is the possibility of either a thread breakage, due to an increased tension, or a thread tangling due to a decreased tension.

There are known devices which associate portions of the mechanism rotating the warp-carrying beam and the take-up roller driving mechanism, for the purpose of assuring a synchronous operation of one with the other. The interrelation of the two driving mechanisms maintains a feeding rate, of the warp wound off the beam or feeding roller, which is equal to the take-up speed of the warp on the take-up rollers. The tension on the warp can be determined manually or automatically.

In devices used to maintain warp tension, usually termed "variators", it is known to use asynchronous single phase motors having an infinitely variable output speed. Such motors are geared to the variators connected to the feed or beam and to the take-up roller driving mechanism, and afford a more variable speed adjustment than is possible with single speed motors, when the latter are used. Such an asynchronous single phase motor is used in the present invention as well as in the speed change gear forming the subject matter of Italian Pat. No. 929,025.

SUMMARY OF THE INVENTION

In accordance with the invention, a device is provided which is particularly adapted for use in textile weaving machines, wherein a strict uniformity in winding off of a warp from a rotatable beam is required. For example, such beam has wound thereon a multi-yarn assembly or body, and the device of the present invention effects strictly tension-controlled winding off of the warp and thus provides for maintaining a constant rate at which the warp is fed to the weaving portion of the textile machine, and ensures a constant tension in the warp.

A device embodying the invention also performs the function of instantaneously stopping rotation of the beam whenever, for any reason, the fabric production has to be arrested, and this is effected by an electric braking of the driving motor for the beam, by metered application of direct current to the windings of the induction motor, such as an asynchronous single phase induction motor. This metered application of direct current to the windings of the asynchronous single phase induction motor is in place of the electronically developed A.C. potential supplied to the motor by an electronic unit defined as an "asynchronous single-phase variator" (in the following merely referred to as "VMA"), and performing the task of speed control as a function of tensiometric data detected by the mechanical pull applied to a tension roller. Such control is effected on the basis of the weaving data as initially preset at the start of operation of the loom, and is maintained throughout production of the fabric until the warp wound on the beam has been completely unwound therefrom. By this accurate control, the geometrical and dimensional uniformity of the features of the fabric loops can be assured.

For an understanding of the principles of the present invention, reference is made to the following description of typical embodiments thereof as illustrated in the accompanying drawings.

DESCRIPTION OF THE PREFERRED EMBODIMENTS

Figure 1:
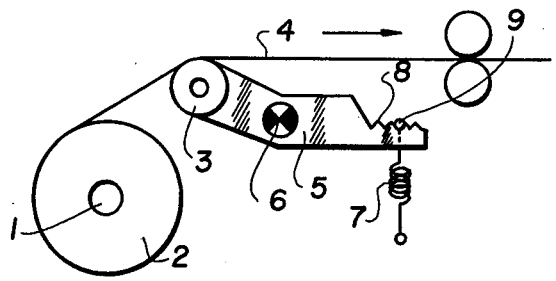
FIG. 1 is a schematic illustration of the arrangement of the elements of a loom to which the tensiometric detection system embodying the present invention can be applied.

Referring first to FIGS. 1–4 of the drawings, a warp beam 1 has orderly wound thereon on a multi-yarn package 2, the yarn of which, upon winding off from warp beam 1, passes over a tension roller 3 to form a multi-thread warp 4 moving in the direction of the arrow to the loom reeds for combining with the weft.

Tension roller 3 is rotatably mounted on one end of a lever arm 5 pivoted, intermediate its ends, at 6, and roller 3 is loaded by a spring 7 having one end secured to a frame and its opposite end connected, at a selected location 9, to a rack 8. Spring 7 determines the restoring torque that roller 3 will exert to hold the yarn from package 2 under tension. The choice of the point 9 on the rack 8 is determined by the load to be imparted to the yarn being wound off warp beam 1, but such tension can be maintained only by maintaining lever arm 5 at its initial position.

The purpose of the control device embodying the invention is just that of continuously maintaining the initial position of lever arm 5, through the controlled winding off of the yarn wound into the package 2 on warp beam 1, so that the warp is under exactly constant tension during the weaving operation.

Figure 4:
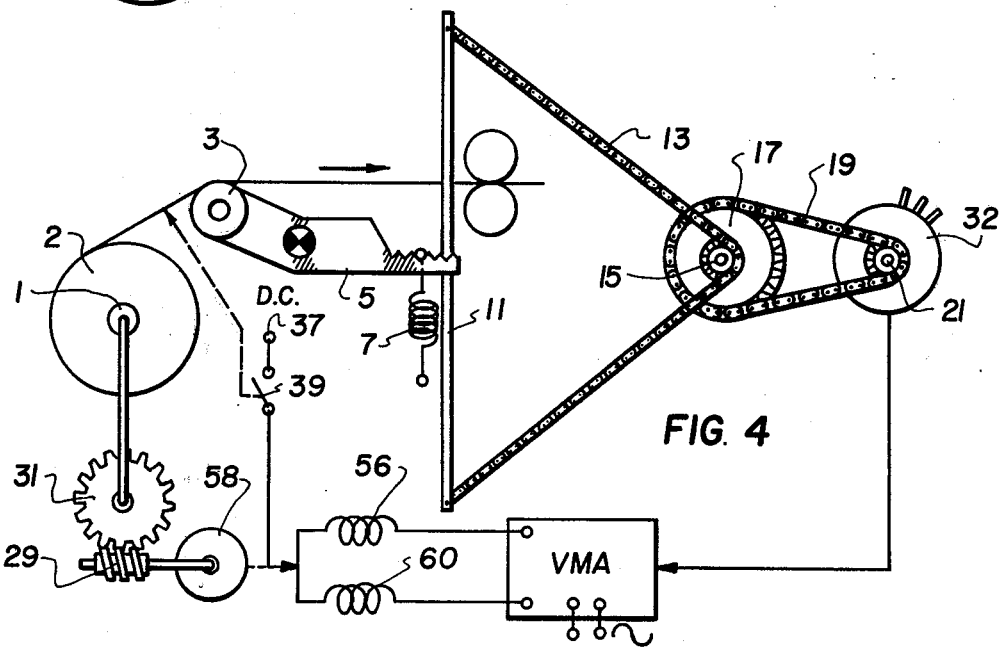
FIG. 4 illustrates the tensiometric detection system of FIG. 1 as arranged to adjust a potentiometer forming a controlling element of a VMA including an asynchronous single phase induction motor driving a warp beam through a substantially non-reversable reduction gearing such as a worm and worm gear.
Figure 5:
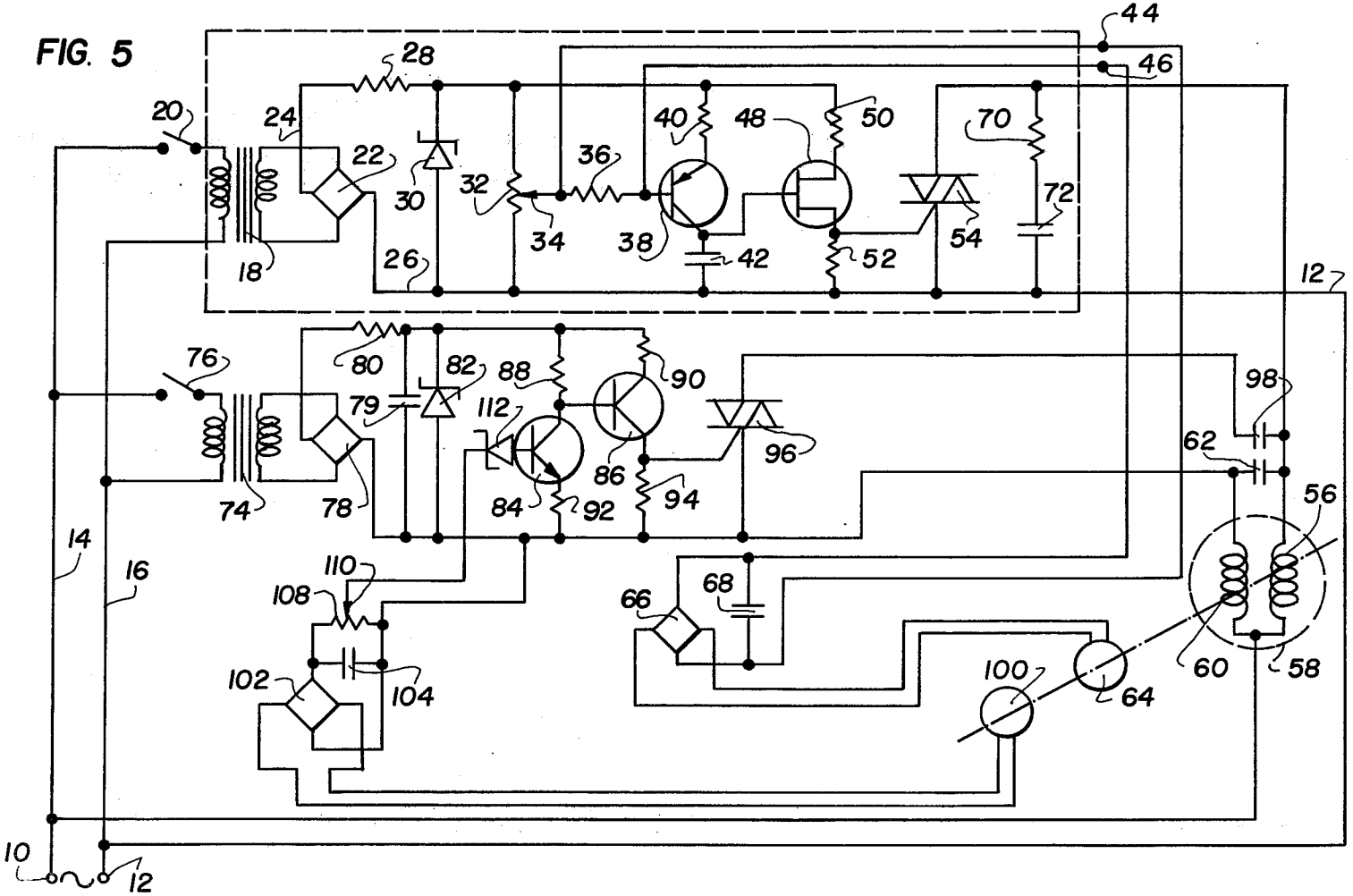
FIG. 5 is a schematic wiring diagram of the VMA.

Referring more particularly to FIG. 4, the opposite end of lever arm 5 is connected to a board 11 having connected, to its opposite ends, the end portions of a chain 13, or the like, meshing with a pinion 15 integral with a larger diameter gear 17 driving, through a chain 19 or the like, a second pinion 21 integral with the axis or shaft of a potentiometer 32 forming part of the VMA shown in FIG. 5. Any displacement of tension roller 3 will cause a displacement of such opposite end of lever arm 5, which is mechanically multiplied by the system 11, 13, 15, 17, 19 and 21, and accordingly will cause a variation in the resistance of potentiometer 32 forming the control element for the asynchronous single phase variator VMA. As particularly illustrated in FIG. 4, variator VMA controls the energization of windings 56 and 60 of an asynchronous induction motor 58 which drives warp beam 1 through a substantially non-reversible reduction gear such as a worm reduction gearing comprising a worm 29 and a worm gear 31. However, other equivalent substantially non-reversible reduction gearings may be used. The single phase variator VMA controls the angular velocity of warp beam 1 to maintain the latter under a strictly constant tension.

Figure 2:
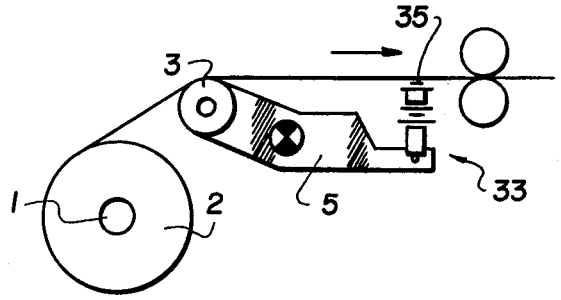
FIG. 2 illustrates a modification of the tensiometric detection system utilizing a pressure-resistance.

In the embodiment of the tensiometric detection system shown in FIG. 2, an electric pressure-resistance detector designated in its entirety at 33, is provided and is connected at one side of the end of lever arm 3 opposite to the end carrying the roller 3, and is connected at the other side to a mechanical stop 35 secured to the frame. In this embodiment of the invention, detection is carried out by compression of detector 33, spring 7 being unnecessary since lever 5 of the tensioning means will be loaded under tension due to lack of yarn supply as a result of irreversibility in the winding off direction of warp beam 1. For example, particular screw-ring ratios in the reduction gearing may be provided to prevent reversibility of the winding off direction.

Figure 3:
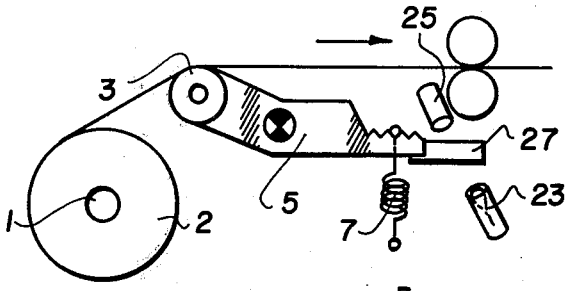
FIG. 3 illustrates a further modification of the tensiometric detection system utilizing a photoelectric cell.

In the embodiment of the tensiometric detection system shown in FIG. 3, a photo-resistance system is provided including a lighting system 23 and a photo-resistance detector 25, with a curtain or shutter 27 being interposed between the elements 23 and 25 and carried by the end of lever arm 5 opposite to the end thereof carrying the rotatable roller 3. The operation of the embodiment shown in FIG. 3 corresponds exactly to the operation of the embodiment shown in FIG. 1.

In the embodiment shown in FIG. 2, the pressure-resistance detector 33 can be substituted, in the VMA, for the potentiometer 32 and, in the embodiment of the invention shown in FIG. 3, the photo-resistance detector 25 can be substituted for the potentiometer 32, in the VMA.

It should be noted that, with the device embodying the invention, the detection of the change in the speed of winding off of the warp from the warp beam 1 does not depend on the diameter of the package 2 wound on the warp beam, but depends on the tension degree imparted initially to tension roller 3. The maintainance of the constancy of the tension until complete winding off of the package 2 from the beam 1 is the essential purpose of the automatic device of the present invention.

The initially presentable tension data can be provided by springs, weights, or any other mechanical restoring torque imposed on the roller 3 of the tensioning means. The pull position establishes the pull amount and is detected on the control of the position of lever arm 5 which, in turn, can be obtained by microdisplacements thereof by amplifying such displacements acting on the mechanical variability of an electric potentiometer, on the screening variability of a light beam by means of the curtain or shutter 27, or by the pressure-resistance detector 33, so as to share the system and rate capability of the data thereof transferred to control unit VMA which, by construction, is consistent with the reception of resistance rates, whether obtained by any of the disclosed means or by equivalent means.

As previously mentioned, in the use of a pressure-resistance detector, the provision of springs or weights is not essential to determine the restoring torque, since any variation in pressure would modify the resistance in the variator VMA which, simultaneously, will provide for correcting the beam winding-off rate, countermaintaining, by yarn winding off, the pressure-static constancy of the tension roller 3 even though no springs or weights are provided.

As also previously mentioned, the variable speed asynchronous induction motor may drive the warp beam 1 through reduction gears having a predominant reduction ratio, for example with the illustrated worm and worm gear, so as to develop a pronounced irreversibility of the transmitted power system, promoting the action of the motor relative to the beam, and not vice-versa. Furthermore, a force is constantly applied to the warp beam 1, this force being provided by the yarn tension, coacting with the beam winding-off in turn controlled by the angular velocity of warp beam 1 as provided by the motor 58.

Substantially, a hardly reversible ratio would promote the speed variability mechanism of the driving motor with a control of the releasing rather than of the trailing action, thus restricting the total amount of the inertial system rates within the resilient fabric clearances.

Referring now to FIG. 5, which illustrates the VMA, a commercial source of A.C. potential, which has not been illustrated, is connected to terminals 10 and 12 and supplies, through lines 14, 16, a low-voltage transformer 18 through a switch 20. Transformer 18 is connected to a rectifier bridge 22 which applies, to the conductors 24, 26, a half-wave rectified voltage in turn applied, through a unit comprising a series resistor 28 and a parallel Zener diode 30, across potentiometer 32. The stabilizing action of Zener diode 30 imparts, to the circuit, a squaring function, so that the voltage applied across potentiometer 32 will consist of a succession of waves or pulses of approximately trapezoidal form, whose maximum amplitude is constant and matches the Zener voltage of Zener diode 30.

The wiper or tap 34 of potentiometer 32 is connected, through a resistor 36, to the base of the transistor 38 polarized by an emitter resistor 40 and having, as a load on its collector, a capacitor 42. Through terminals 44 and 46, there is applied, across resistor 36, a D.C. voltage feedback signal supplied by a circuit described hereinafter.

The collector of transistor 38 is also connected to the control electrode of the unijunction transistor 48 polarized by the respective resistors 50 and 52. The junction between unijunction transistor 48 and resistor 52 is connected to the control electrode of a triac 54, having one pole connected to supply terminal 12 and its opposite pole connected to supply terminal 10 through the main stator winding 56 of single phase induction motor 58. Motor 58 further includes the series arrangement of an auxiliary winding 60 and a capacitor 62, connected in parallel with main winding 56.

A tachometer alternator 64, secured on the shaft of motor 58, generates an A.C. voltage of an amplitude porportional to the angular velocity of motor 58. This voltage is applied to rectifier bridge 66 whose output is connected to terminals 44, 46 through a smoothing capacitor 68 connected in parallel with rectifier bridge 68.

A series arrangement of a resistor 70 and a capacitor 72 is connected in parallel with triac 54 for the purpose of filtering the high frequencies generated by the firings of triac 54.

That part of the circuit of FIG. 1 already described operates in the following manner. It is assumed that motor 58 is already in rotation at a steady speed and that potentiometer 32 is adjusted to a desired position. Tachometer alternator 64 and rectifier 66, which latter is in parallel with smoothing capacitor 68, supply, across resistor 36, a D.C. voltage of an amplitude proportional to the speed of rotation of motor 68 and which is added algebraically to the trapezoidal voltage tapped by tap 34 of potentiometer 32. The circuit is rated so that zero voltage will be applied on the base of transistor 38 when the speed of rotation of motor 58 effects, on resistor 36, a signal voltage whose amplitude is equal, in absolute value, to the amplitude of the voltage tapped by tap 34 of potentiometer 32. The voltage applied to the base of transistor 38 will, however, be positive if the motor 58 runs at a speed below that set by the potentiometer 32, or will be negative, if the speed of motor 58 is higher than that set.

If motor 58 runs at a speed equal to or higher than that set, transistor 38 remains permanently non-conducting, capacitor 42 cannot be charged, unijunction transistor 48 is not fired, and consequently also triac 54 forms an open circuit in series with winding 56 of motor 58.

Assume now that motor 58 runs at a speed lower than that set. In this case, transistor 38 will be triggered conductive by the positive voltage applied to its base and it will therefore charge capacitor 42 with a charging current whose strength increases with the control voltage on the base. As soon as the voltage across capacitor 42 reaches the firing value of unijunction transistor 48, the latter fires, discharging capacitor 42 through resistor 52, producing a voltage pulse of the terminals of resistor 52 and thus piloting triac 54 which will therefore close the supply circuit to motor winding 56. The conduction of triac 54 will continue for the remaining part of the A.C. supply cycle.

It will be clear that, in practice, in case of a constant stall torque on the shaft of motor 58, there occurs a stable pendulum condition in which the conduction of transistor 38 will be such as to charge capacitor 42 at a rate which causes the correct chopping of the A.C. voltage supplied to motor winding 56, and also to auxiliary winding 60 in series with capacitor 62.

The arrangement shown in FIG. 5 also includes a torque increasing circuit for low angular velocities of motor 58. For this purpose, a second low-voltage transformer 74 has as primary connected, through a switch 76, to conductors 14, 16 connected to the power supply. The output voltage of the secondary transformer 74 is rectified by a rectifying diode bridge 78 and applied, through the combination comprising a parallel capacitor 79, a series resistor 80, and a parallel Zener diode 82, to the terminals of two transistors 84, 86 in cascade and polarized by respective collector resistors 88, 90 and respective emitter resistors 92, 94. The junction between the emitter of transistors 86 and resistor 94 is connected to the control electrode of a triac 96, one terminal of which is connected to the junction point between auxiliary winding 60 of motor 58 and the associated capacitor 62, while the opposite terminal is connected to a capacitor 98 which is in parallel with capacitor 62.

A second tachometer alternator 100, secured on the shaft of motor 58, supplies a rectifier bridge 102 whose output is connected to the terminals of a smoothing capacitor 104 to which is connected, in parallel, a potentiometer 108. Tap 110 of potentiometer 108 is connected to the base of transistor 84 through a Zener diode 112.

This torque-increasing circuit operates in the following manner. When motor 58 rotates at a speed so low that the voltage on the base of transistor 84 is lower than the release voltage of transistor 84, this transistor is cut off and therefore its collector is at high potential and maintains transistor 86 conductive. Therefore, at the terminals of resistor 94, there occurs a potential difference which maintains triac 96 constantly conducting to assert capacitor 98 in parallel with capacitor 62, thereby introducing a strong capacitance in the auxiliary circuit of motor 58, to increase the phase shift between the shields of windings 56 and 60 and therefore to increase the torque supplied by motor 58.

When the speed of rotation of motor 58 is increased to a value such as to cause the unblocking of transistor 84, the potential on the collector of this transistor decreases to a low value, cutting off transistor 36 and thus blocking triac 96. As a result, capacitor 98 is effectively cut out of the circuit, thereby reducing the capacitance inserted between the windings 56, 60 of motor 58, as is required by high speeds of rotation.

Such a torque increasing circuit is therefore inserted upon start of the motor 58 to furnish a high static torque, until the speed reached permits cutting out of the capacitor 98. The threshold speed for the cutting out of capacitor 98 can be adjusted by means of potentiometer 108. As stated, the thus described VMA controls the speed of motor 58 and in turn controls the winding off speed of warp beam 1.

In accordance with a further feature of the invention, the device embodying the invention provides a possibility of rapid braking by application of direct current to induction motor 58, this insuring that, at each shutdown in the loom, the supply of warp threads will be arrested for the yarn wound up on the package 2 on warp beam 1, so as not to vary, at the starting, the extent of the warp tension. Such an arrangement is schematically illustrated in FIG. 4, wherein a source of direct current, indicated at 37, is connected through a switch 39 to the windings 56 and 60 of motor 58. The switch 39 may be operated responsive to breakage of the warp threads or to stopping of the feeding thereof.

Finally, it should be noted that the absolute steadiness of the entire system, and the simplicity and low cost of the mechanisms comprising the system, enhances the novelty of the device embodying the invention.

While specific embodiments of the invention have been shown and described in detail to illustrate the application of the principles of the invention, it will be understood that the invention may be embodied otherwise without departing from such principles.

What is claimed is:

1. A low inertia control device, for the continuous electromechanical control of the winding-off of a warp yarn wound up on a warp beam by sensing the tension of the wound-off yarn, said device comprising, in combination, an induction motor; reduction gearing, with a high reduction ratio and a substantial irreversibility, drivingly connecting said induction motor to said warp beam; yarn tension detecting means engaging the wound-off warp yarn; an electronic speed control connected between a source of potential and said induction motor and operable to infinitely vary the speed of said motor and to brake said motor substantially instantaneously; and a tension-potential transducer connected to said yarn tension detecting means and forming part of said electronic speed control, and operable to control said electronic speed control to continuously modulate the potential applied to said motor in accordance with the detected tension of the wound-off warp yarn to continuously modulate the speed of said motor to maintain constant the tension of the wound-off warp yarn.

2. A low inertia control device, as claimed in claim 1, in which said yarn tension detecting means comprises a lever arm pivotally mounted adjacent the warp yarn and having a portion contacting the warp yarn, and bised against the warp yarn; said yarn tension detecting means comprising lever arm displacement sensing means connected to said lever arm and to said tension-potential transducer.

3. A low inertial control device, as claimed in claim 2, including a detection-pressure-resistance system; said lever arm acting directly on said detection-pressure-resistance system; said detection-pressure-resistance system constituting said tension-potential transducer.

4. A low inertia control device, according to claim 2, in which said yarn tension detecting means comprises a curtain connected to said lever arm, a light source, and a photo-resistance; said curtain being interposed between said light source and said photo-resistance.

5. A low inertia control device, according to claim 2, in which said tension-potential transducer is a potentiometer; and a mechanical multiplication system for said lever arm connecting said lever arm to said potentiometer.

6. A low inertia control device, as claimed in claim 5, in which said mechanical multiplication system comprises an elongated board pivotally connected, intermediate its ends, to said lever arm for displacement responsive to displacement of said lever arm; a drive chain connected to opposite ends of said board; a pinion engaged with said drive chain for rotation of said pinion with displacement of said drive chain; and gear means engaged between said poentiometer and said pinion to adjust said potentiometer responsive to rotation of said pinion.

7. A low inertia control device, according to claim 1, in which said electronic speed control includes means operable to supply a metered direct current to the windings of said induction motor to brake said induction motor.

* * * * *